United States Patent [19]

Brecht

[11] 4,128,826

[45] Dec. 5, 1978

[54] ELECTRICAL HIGH-VOLTAGE APPARATUS

[75] Inventor: Heinz Brecht, Berlin, Fed. Rep. of Germany

[73] Assignee: Siemens Aktiengesellschaft, Berlin and Munich, Fed. Rep. of Germany

[21] Appl. No.: 802,425

[22] Filed: Jun. 1, 1977

[30] Foreign Application Priority Data

Jun. 18, 1976 [DE] Fed. Rep. of Germany ..... 2627769

[51] Int. Cl.[2] ..... H01C 7/18

[52] U.S. Cl. ..... 338/204; 338/20; 338/215

[58] Field of Search ..... 338/204, 21, 20, 215; 200/144 AP; 361/132

[56] References Cited

U.S. PATENT DOCUMENTS

| | | | |
|---|---|---|---|
| 2,311,852 | 2/1943 | McFarlin | 361/132 X |
| 3,676,621 | 7/1972 | Pflanz | 200/144 AP |
| 4,069,406 | 1/1978 | Meinders | 338/204 X |

FOREIGN PATENT DOCUMENTS

| | | | |
|---|---|---|---|
| 1263597 | 2/1972 | United Kingdom | 338/21 |

*Primary Examiner*—C. L. Albritton

*Attorney, Agent, or Firm*—Kenyon & Kenyon, Reilly, Carr & Chapin

[57] ABSTRACT

An electrical high-voltage apparatus wherein a plurality of resistor disks are arranged along and carried by a shaft and wherein a centering body is also arranged along the region of the shaft carrying the resistor disks. The centering body comprises first and second members which are movable relative to one another, and at least one of which has actuating edges. The centering body is further provided with several radially outward-pointing support elements which are distributed over the circumference of the body and which have radial inner chamfers which cooperate with the corresponding actuating edges of the one member.

10 Claims, 7 Drawing Figures

ELECTRICAL HIGH-VOLTAGE APPARATUS

BACKGROUND OF THE INVENTION

1. Field of the Invention

The invention relates to an electrical high-voltage apparatus in which a plurality of resistor disks are arranged along a shaft, the latter shaft being disposed in and spaced from the interior of a hollow insulator bushing.

2. Description of the Prior Art

In high-voltage switchgear and, in particular, high-voltage power circuit breakers, it is customary to associate with the switching gap surge resistors which are at a high-voltage potential and are arranged within and spaced from the interior of a hollow cylindrical insulator bushing. The aforesaid insulator bushing also has within its interior an auxiliary switching point which is controlled by the drive actuating the main switching gap.

It is an object of the present invention to provide a high-voltage apparatus of the above type in which the spacing between the resistor disks and the interior walls of the hollow cylindrical insulator bushing is kept as constant as possible.

SUMMARY OF THE INVENTION

The above and other objectives are accomplished in accordance with the principles of the present invention in a high-voltage apparatus as above-described by further including therein a centering body which is arranged along the region of the shaft carrying the disk resistors and which comprises first and second members which are movable relative to one another, and at least one of which has actuating edges. The centering body is further provided with several radially outward-pointing movable support elements which are distributed over its circumference and which have radially inner chamfers or sloping edges which cooperate with corresponding actuating edges of the aforesaid one member.

With the apparatus of the invention configured as above-described, the centering body causes centering of the stacked resistors disks as soon as the body is loaded with the necessary contact pressure. In this manner, assembly and disassembly of the apparatus during installation and maintenance are substantially facilitated. Moreover, a more accurate actuation of an auxiliary switching gap controlled by the apparatus is also made possible.

The first and second members forming the centering body, advantageously, may comprise an electrically conductive material. In such case, the first and second members provide a means for electrically connecting the two resistor disks located on opposite sides of the centering body. Additionally, a current-carrying strap may be used to electrically connect the first and second members should the contact surfaces between the members be insufficient in operation to conduct the current flowing through the disk resistors.

The support elements of the centering body may, advantageously, be made at least partially of electrically insulating material. More particularly, the surfaces of these elements which cooperate with the first and second members of the centering body may be formed of electrically conductive material and may be used in this manner to conduct the current flowing through the disk resistors. However, for reasons of high-voltage design, the portions of the support elements adapted to face the inside wall surfaces of the hollow cylindrical insulator bushing should comprise an electrically insulating material.

In one embodiment of the invention to be disclosed hereinafter, a compression spring is arranged between the first and second members of the centering body. In this manner, a centering body is realized which during disassembly of the disk resistors becomes detached when the contact pressure required for the resistor is reduced.

In a further embodiment of the invention to be disclosed hereinafter, the support elements are preferably individually adjustable pins with conical chambers, and the actuating edges are formed by conical pins at the one member of the centering body. In this case, a spherical body may also be interposed between each support element and its corresponding actuating edge.

In still a further embodiment of the invention to be disclosed hereinafter, each support element is formed as a spherical body, and each actuating edge has a conical contour cooperating with its corresponding spherical body. The spherical bodies preferably comprise insulating material.

The electrical high-voltage apparatus of the invention may be advantageously designed so that the diameter of the centering body is equal to that of the resistor disks. In this manner, no inhomogeneous electric fields are obtained. Additionally, to obtain favorable symmetry, the centering body may include three support elements.

BRIEF DESCRIPTION OF THE DRAWING

The above and other features and aspects of the present invention will become more apparent upon reading the following detailed description in conjunction with the accompanying drawings, in which.

DETAILED DESCRIPTION

Figure 1:
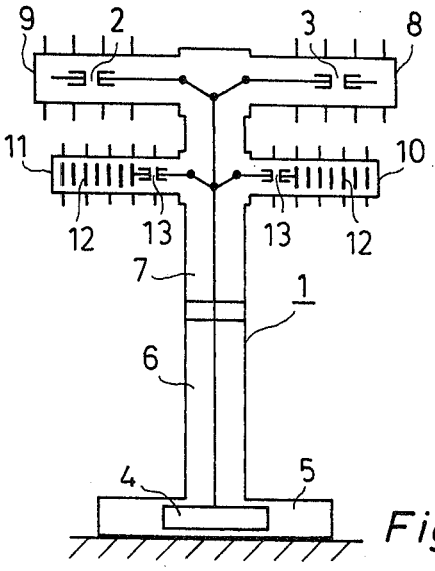
FIG. 1 is a schematic view of an electric high-voltage apparatus in accordance with the principles of the present invention.

FIG. 1 shows an electric high-voltage apparatus in the form of a high-voltage power circuit breaker 1 of outdoor design. The high-voltage breaker 1 comprises two switching gaps 2 and 3 which are at high-voltage potential and which are controlled by a common drive 4 which is at ground potential. The drive 4 is housed within the base 5 of the power circuit breaker. Extending upwardly from the base 5 are two support insulators 6, 7 which carry hollow insulator bushings 8, 9 in which are housed the gaps 2 and 3. Below the switching gaps 2 and 3, surge resistors 10, 11 are provided, each of which resistors comprises a stack 12 of resistor disks and auxiliary switching gaps 13. The latter gaps are controlled by the drive 4 which actuates the switching gaps 2 and 3.

Figure 2:
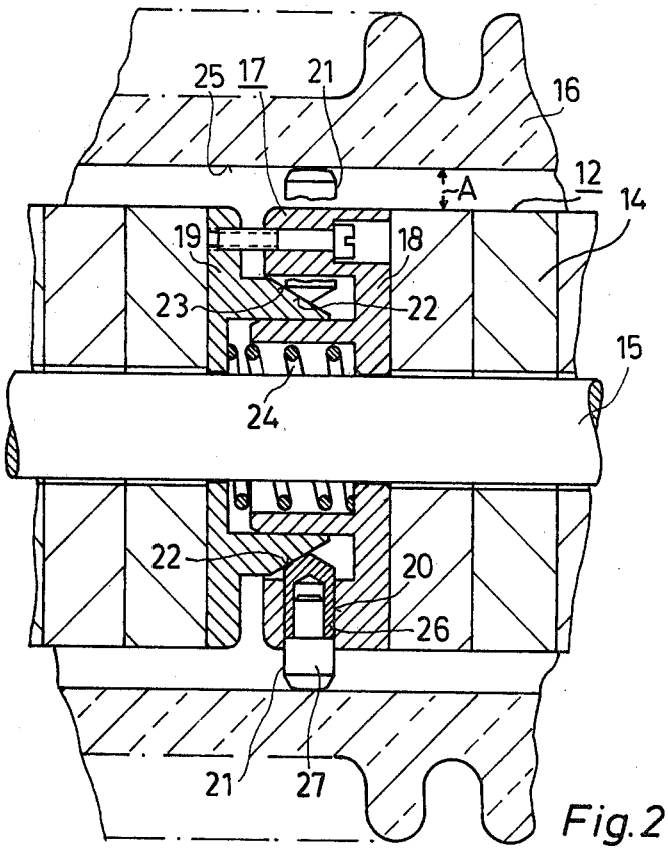
FIG. 2 illustrates in schematic fashion a cross-section of the centering body of the apparatus of FIG. 1.
Figure 3:
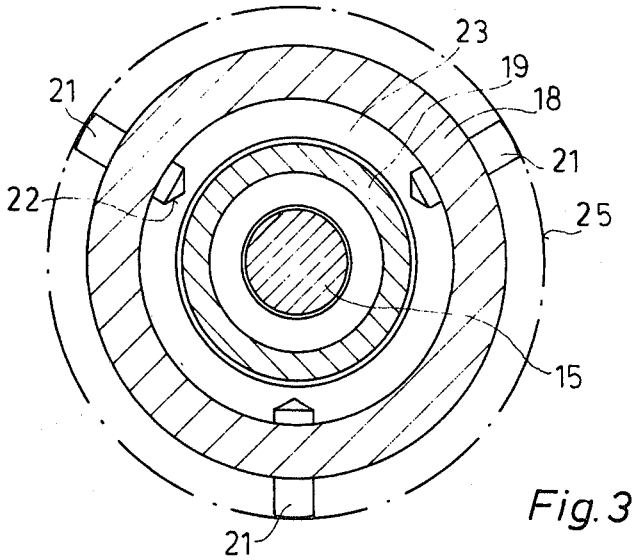
FIG. 3 shows a side elevation view of the centering body of FIG. 2.

FIG. 2 shows a cross section view and FIG. 3 an elevation view of a portion of the resistor stack 12 of the breaker 1 of FIG. 1. As shown, the resistor disks 14, which are electrically connected in series, are mounted on a shaft 15 which is arranged in the interior of a hollow insulator bushing 16. Also arranged on the shaft 15 within the stack 12 is a centering body 17 which comprises first and second members 18, 19 which can be moved relative to one another. The first member 18 has radially outward-pointing holes 20, which are provided for guiding outward-pointing movable support elements 21. As shown, three support elements 21 are distributed over the circumference of the member 18 of the body 17. Each support element has radially inner chamfers 22 which cooperate with corresponding actuating edges 23 provided on a central conical section of the second member 19. A compression spring 24 is further arranged between the first and second members 18, 19 of the body 17.

With the centering body 17 configured as above-described, pressing of the members 18, 19 against the force of the spring 24 via the resistor disks loaded by a contact pressure spring (not specifically shown), causes the actuating edges 23 to push the support elements 21 radially outward through wedge action. As this action assures that the elements 21 move outward in the same manner, a uniform spacing A of the resistor stack from the inside wall surface 25 of the insulator bushing 16 is ensured.

As shown in FIG. 2, each support element 21 is formed from two portions 26 and 27. Advantageously, the radially inner portion 26 comprises an electrically conductive material, while the radially outer potion 27 comprises an insulating material.

FIGS. 4 to 7 show further embodiments of the centering body of an apparatus in accordance with the principles of the present invention. In these embodiments, the same elements as those in FIGS. 1–3 have been labelled with the same reference numbers.

Figure 4:
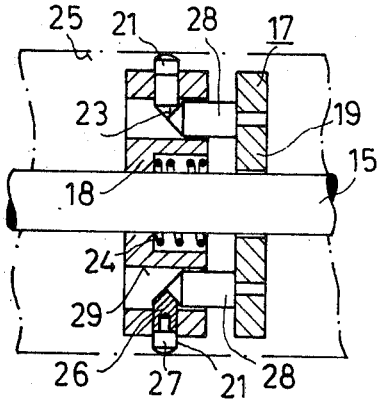
FIG. 4 shows also in schematic fashion a further embodiment of the centering body of an electric high-voltage apparatus in accordance with the principles of the present invention.

In the embodiment of FIG. 4, the centering body 17 comprises a second member 19 having pins 28 whose number equals that of the support elements 21. The actuating edges 23 of the member 19 are thus formed by the conical surfaces of the pins 28. The pins 28 run in parallel holes 29 of the first member 18, the holes 29 being parallel to the shaft 15 and being in communication with the respective holes in the member 18 through which the elements 21 are guided.

Figure 5:
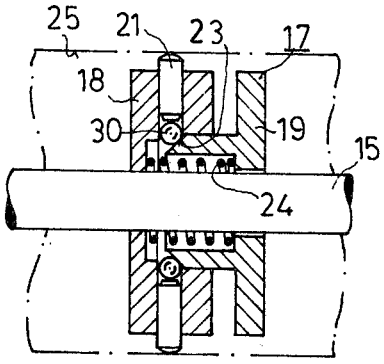
FIGS. 5 through 7 illustrate yet further embodiments of centering bodies of electrical apparatus in accordance with the principles of the present invention.

The embodiment of the invention shown in FIG. 5 is substantially similar to the embodiment shown in FIG. 2. However, in FIG. 5, the support elements 21 are comprised solely of insulating material and an insulating spherical body 30 is disposed between the inner chamfered edge of each element 21 and its corresponding actuating edge 23 of the member 19.

Figure 6:
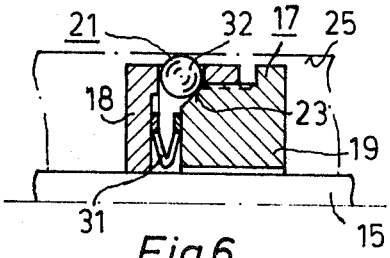

In the embodiment of the invention shown in FIG. 6, the first and second members 18, 19 of the centering body 17 are connected in an electrically conducting manner by a jumper ribbon 31. Moreover, in this embodiment the actuating edges of the member 19, are formed with a conical extension and the support elements 21 are formed as spheres 32 comprised of insulating material. In this embodiment, a compression spring may also be provided between the members 18 and 19.

Figure 7:
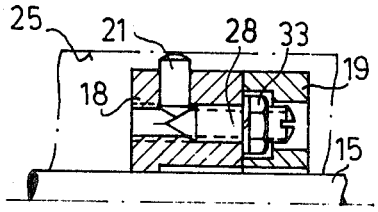

The embodiment of the invention illustrated in FIG. 7, is similar to the embodiment of FIG. 4 with the exception that the pins 28 are threaded and have associated therewith threaded nuts 23. With this configuration, an exact adjustment of each support element 21, and thus, accurate centering of the centering body can be realized.

What is claimed is:

1. An electric high-voltage apparatus adapted to be arranged within the interior of a hollow cylindrical insulating bushing member and in spaced relationship to the interior surfaces thereof, said apparatus comprising:
   - a shaft;
   - a plurality of resistor disks arranged along and carried by said shaft;
   - a centering body arranged on said shaft in the region thereof carrying said resistor disks, said centering body comprising:
     - first and second members which are movable relative to one another, at least one of said first and second members having actuating edges;
     - several radially outward-pointing, movable support elements distributed over the circumference of said body each having a radially inner chamfer for cooperating with a corresponding actuating edge of said one member.

2. An apparatus in accordance with claim 1 wherein: said first and second members comprise an electrically conductive material.

3. An apparatus in accordance with claim 1 wherein: each of said support elements is comprised, at least in part, of an electrically insulating material.

4. An apparatus in accordance with claim 1 wherein said body further comprises:
   - a compression spring disposed between said first and second members.

5. An apparatus in accordance with claim 1 wherein:
   - each of said support elements is a pin having a conical chamfer;
   - and each of said actuating edges is formed by a conical pin forming a part of said one member.

6. An apparatus in accordance with claim 1 further comprising:
   - a number of spherical bodies, each arranged between a support element and its corresponding actuating edge.

7. An apparatus in accordance with claim 1 wherein:
   - each of said support elements is a spherical body;
   - and each of said edges of said one member is formed by a conical contour which cooperates with the spherical body forming the support element corresponding to that edge.

8. An apparatus in accordance with claim 5 wherein: each of said pins is individually adjustable.

9. An apparatus in accordance with claim 1 wherein: said centering body has a diameter equal to the diameter of said resistor disks.

10. An apparatus in accordance with claim 1 wherein: said centering body comprises three support elements.

* * * * *